US009868286B2

(12) United States Patent
Igarashi

(10) Patent No.: US 9,868,286 B2
(45) Date of Patent: Jan. 16, 2018

(54) LIQUID DISCHARGE APPARATUS

(71) Applicant: Masanori Igarashi, Kanagawa (JP)

(72) Inventor: Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/369,605

(22) Filed: Dec. 5, 2016

(65) Prior Publication Data

US 2017/0165971 A1 Jun. 15, 2017

(30) Foreign Application Priority Data

Dec. 15, 2015 (JP) ..... 2015-244376

(51) Int. Cl.
*B41J 2/165* (2006.01)

(52) U.S. Cl.
CPC ..... *B41J 2/16523* (2013.01); *B41J 2/1652* (2013.01); *B41J 2/16508* (2013.01); *B41J 2/16532* (2013.01); *B41J 2/16538* (2013.01); *B41J 2002/16573* (2013.01)

(58) Field of Classification Search
CPC ..... B41J 2/16538; B41J 2/16535; B41J 2/16508; B41J 2/1652; B41J 2/16547; B41J 2002/16573; B41J 2/16523; B41J 2/165; B41J 2/16532; B41J 2/16517; B41J 2002/16514
USPC ..... 347/22, 29, 30, 33, 34, 36
See application file for complete search history.

(56) References Cited

U.S. PATENT DOCUMENTS

2008/0174631 A1* 7/2008 Habashi ..... B41J 2/16585 347/30
2008/0238982 A1 10/2008 Kaneko et al.
2011/0057998 A1 3/2011 Igarashi
2011/0221801 A1 9/2011 Igarashi
2012/0007903 A1 1/2012 Igarashi
2012/0306950 A1 12/2012 Kobayashi et al.
2013/0321501 A1 12/2013 Igarashi
2014/0253632 A1* 9/2014 Matsumoto ..... B41J 2/1652 347/33

FOREIGN PATENT DOCUMENTS

JP 11-240165 9/1999
JP 2006-150873 6/2006
JP 2014-151457 8/2014

* cited by examiner

*Primary Examiner* — Jannelle M Lebron
(74) *Attorney, Agent, or Firm* — Duft Bornsen & Fettig LLP

(57) ABSTRACT

A liquid discharge apparatus includes a liquid discharge head, a cap, a wiper, a maintenance device, and a maintenance controller. Receiving an execution instruction of a maintenance operation, the maintenance controller controls the maintenance device to perform a second maintenance operation when an amount of stain of a nozzle face of the head from a preceding round of the second maintenance operation is equal to or greater than a first threshold and an elapsed time from the preceding round of the second maintenance operation is equal to or greater than a second threshold, and controls the maintenance device to perform a first maintenance operation when the amount of stain of the nozzle face from the preceding round of the second maintenance operation is equal to or greater than the first threshold and the elapsed time from the preceding round of the second maintenance operation is smaller than the second threshold.

6 Claims, 12 Drawing Sheets

FIG. 8

| TEMPERATURE (T) / HUMIDITY (H) | T < 10°C | 10°C ≤ T < 30°C | T ≥ 30°C |
|---|---|---|---|
| 0% ≤ H < 30% | 10 | 5 | 10 |
| 30% ≤ H < 70% | 2 | 1 | 2 |
| 70% ≤ H ≤ 100% | 2 | 1 | 2 |

FIG. 9

| LARGE DROPLET | MIDDLE DROPLET | SMALL DROPLET |
|---|---|---|
| 1 | 2 | 8 |

LIQUID DISCHARGE APPARATUS

CROSS-REFERENCE TO RELATED APPLICATION

This patent application is based on and claims priority pursuant to 35 U.S.C. §119(a) to Japanese Patent Application No. 2015-244376 filed on Dec. 15, 2015 in the Japan Patent Office, the entire disclosure of which is hereby incorporated by reference herein.

BACKGROUND

Technical Field

Aspects of this disclosure relate to a liquid discharge apparatus.

Related Art

A liquid discharge apparatus including a liquid discharge head to discharge liquid performs a maintenance operation to maintain and recover the conditions of nozzles.

SUMMARY

In an aspect of the present disclosure, there is provided a liquid discharge apparatus that includes a liquid discharge head, a cap, a wiper, a maintenance device, and a maintenance controller. The liquid discharge head has a nozzle face in which a plurality of nozzles is arrayed to discharge liquid. The cap caps the nozzle face. The wiper wipes the nozzle face. The maintenance device includes a suction unit connected to the cap. The maintenance controller controls the maintenance device to perform a maintenance operation on the liquid discharge head. The maintenance operation includes a first maintenance operation and a second maintenance operation. The second maintenance operation includes at least one of an operation in which a number of times of wiping of the wiper is greater than in the first maintenance operation, an operation in which a number of times of suction of the nozzle face by the suction unit with the nozzle face capped with the cap is greater than in the first maintenance operation, and an operation in which at least one of a suction amount and a suction speed of the nozzle face by the suction unit with the nozzle face capped with the cap is greater than in the first maintenance operation. The maintenance controller includes a calculator to calculate an amount of stain of the nozzle face from a stain correlation value correlated with a degree of stain of the nozzle face. Receiving an execution instruction of the maintenance operation, the maintenance controller controls the maintenance device to perform the second maintenance operation when an amount of stain of the nozzle face from a preceding round of the second maintenance operation is equal to or greater than a first threshold and an elapsed time from the preceding round of the second maintenance operation is equal to or greater than a second threshold, and controls the maintenance device to perform the first maintenance operation when the amount of stain of the nozzle face from the preceding round of the second maintenance operation is equal to or greater than the first threshold and the elapsed time from the preceding round of the second maintenance operation is smaller than the second threshold.

In an aspect of the present disclosure, there is provided a liquid discharge apparatus that includes a liquid discharge head, a cap, a wiper, a maintenance device, and a maintenance controller. The liquid discharge head has a nozzle face in which a plurality of nozzles is arrayed to discharge liquid. The cap caps the nozzle face. The wiper wipes the nozzle face. The maintenance device includes a suction unit connected to the cap. The maintenance controller controls the maintenance device to perform a maintenance operation on the liquid discharge head, the maintenance operation including a first maintenance operation and a second maintenance operation. The second maintenance operation includes at least one of an operation in which a number of times of wiping of the wiper is greater than in the first maintenance operation, an operation in which a number of times of suction of the nozzle face by the suction unit with the nozzle face capped with the cap is greater than in the first maintenance operation, and an operation in which at least one of a suction amount and a suction speed of the nozzle face by the suction unit with the nozzle face capped with the cap is greater than in the first maintenance operation.

The maintenance controller includes a calculator to calculate an amount of stain of the nozzle face from a stain correlation value correlated with a degree of stain of the nozzle face. Receiving an execution instruction of the maintenance operation, the maintenance controller controls the maintenance device to perform the second maintenance operation when an amount of stain of the nozzle face from a preceding round of the second maintenance operation is smaller than a first threshold and an elapsed time from the preceding round of the second maintenance operation is equal to or greater than a second threshold, and controls the maintenance device to perform the first maintenance operation when the amount of stain of the nozzle face from the preceding round of the second maintenance operation is smaller than the first threshold and the elapsed time from the preceding round of the second maintenance operation is smaller than the second threshold.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 8 is a table of environmental coefficients used to calculate the amount of stain of a nozzle face;

FIG. 9 is a table of droplet-type coefficients used to calculate the amount of stain of a nozzle face;

Figure 1:
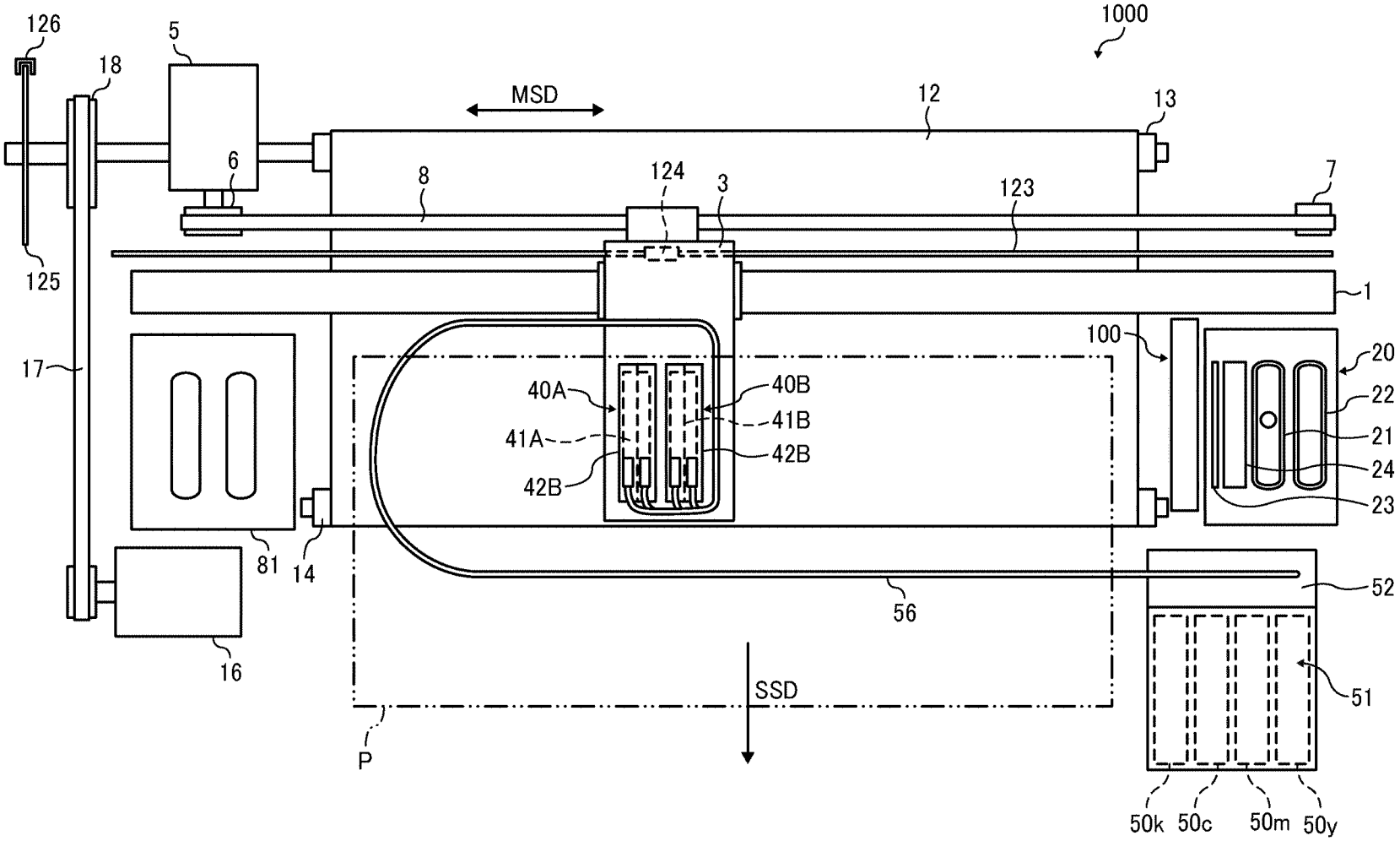
FIG. 1 is a plan view of a mechanical section of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
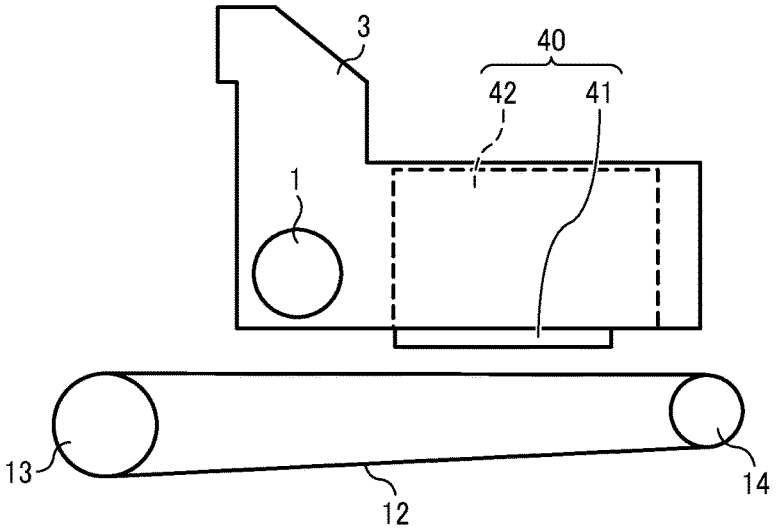
FIG. 2 is a side view of a portion of the mechanical section of FIG. 1.
Figure 3:
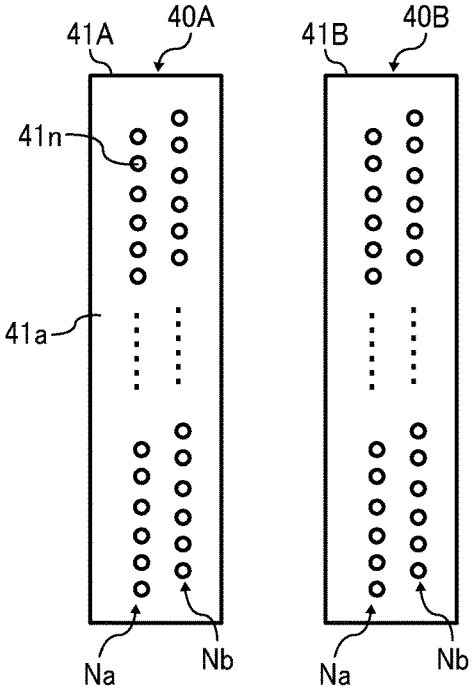
FIG. 3 is a plan view of a configuration of liquid discharge heads of the liquid discharge apparatus of FIG. 1.

Referring now to the drawings, wherein like reference numerals designate identical or corresponding parts throughout the several views, embodiments of the present disclosure are described below. First, a liquid discharge apparatus 1000 according to an embodiment of this disclosure is described with reference to FIGS. 1 through 3. FIG. 1 is a plan view of a mechanical section of a liquid discharge apparatus according to an embodiment of the present disclosure. FIG. 2 is a partial side view of a portion of the mechanical section of FIG. 1. FIG. 3 is a plan view of a configuration of liquid discharge heads of the mechanical section. FIG. 3 a transparent view of the liquid discharge heads seen from above.

A liquid discharge apparatus 1000 according to the present embodiment is a serial-type liquid discharge apparatus and includes a guide assembly, such as a main guide 1, to movably support a carriage 3 in a main scanning direction indicated by arrow MSD in FIG. 1. A main scanning motor 5 constituting part of a main scan moving unit reciprocally moves the carriage 3 in the main scanning direction MSD (a carriage movement direction) via a timing belt 8 laterally bridged between a drive pulley 6 and a driven pulley 7.

Two liquid discharge units 40A and 40B (collectively referred to as liquid discharge units 40 unless distinguished, which is the same in the following other members) are mounted on the carriage 3. Each of the liquid discharge units 40 is an integral unit of a liquid discharge head 41 as a liquid discharge device and a head tank 42 to supply liquid to the liquid discharge head 41.

As illustrated in FIG. 3, the liquid discharge head 41 includes two nozzle rows Na and Nb, each including a plurality of nozzles 41*n* arrayed in a row. For example, one nozzle row Na of the liquid discharge head 41A of the liquid discharge unit 40A discharges droplets of black (K) and the other nozzle row Nb discharges droplets of cyan (C). One nozzle row Na of the liquid discharge head 41B of the liquid discharge unit 40B discharges droplets of magenta (M) and the other nozzle row Nb discharges droplets of yellow (Y).

In some embodiments, as the liquid discharge device, a single liquid discharge head may be used that has a nozzle face in which multiple nozzle rows, each including multiple nozzles arrayed in a row, are arrayed to discharge droplets of respective colors.

Each of the head tank 42A and the head tank 42B includes paired tank portions corresponding to the two nozzle rows Na and Nb of each of the liquid discharge heads 41A and 41B.

A cartridge holder 51 is disposed at an apparatus body of the liquid discharge apparatus 1000. Main tanks (liquid cartridges) 50 (50*y*, 50*m*, 50*c*, and 50*k*) to contain liquid of the respective colors are removably mounted to the cartridge holder 51.

The cartridge holder 51 includes a liquid feed pump unit 52 to supply liquid of the respective colors from the main tanks 50 to the tank portions of the head tanks 42A and 42B via supply tubes (also referred to as liquid supply passages) 56 for the respective colors.

To convey a sheet material P, the liquid discharge apparatus 1000 also includes a conveyance belt 12 as a conveyor to attract the sheet material P and convey the sheet material P to a position opposing the liquid discharge heads 41 of the liquid discharge units 40. The attraction of the sheet material P with the conveyance belt 12 is performed by electrostatic attraction or air attraction.

The conveyance belt 12 is an endless belt and is stretched between a conveyance roller 13 and a tension roller 14. The conveyance roller 13 is rotated by a sub-scanning motor 16 via a timing belt 17 and a timing pulley 18, so that the conveyance belt 12 circulates in a sub-scanning direction indicated by arrow SSD in FIG. 1.

On one side in the main scanning direction MSD of the carriage 3, a maintenance device 20 to maintain and recover the liquid discharge heads 41 is disposed at a lateral side of the conveyance belt 12. On the other side in the main scanning direction MSD of the carriage 3, a first dummy ejection receptacle 81 to receive preliminarily-discharged liquid (dummy discharged liquid) from the liquid discharge heads 41 is disposed at another lateral side of the conveyance belt 12. Note that the term "dummy discharge" used herein represents the discharge performed to maintain and recover the conditions of nozzles and the term "regular discharge" used herein represents the discharge performed to achieve an original purpose (for example, printing) of the liquid discharge apparatus.

The maintenance device 20 includes, for example, a suction cap 21 and a moisture-retention cap 22 to cap the nozzle faces 41*a* of the liquid discharge heads 41, a wiper 23 to wipe the nozzle faces 41*a*, and a second dummy discharge receptacle 24 to receive liquid discharged by dummy discharge. Note that, in some embodiments, by the dummy discharge, liquid may be discharged into the suction cap 21.

Between the conveyance belt 12 and the maintenance device 20, a discharge sensor unit 100 constituting a discharge detector to detect a discharge state of the nozzles 41*n* of the liquid discharge heads 41 is disposed in an area in which the discharge sensor unit 100 can oppose the liquid discharge heads 41.

An encoder scale 123 with a predetermined pattern is laterally bridged along the main scanning direction MSD between side plates. An encoder sensor 124 being a transmissive photosensor to read a pattern of the encoder scale 123 is mounted on the carriage 3. The encoder scale 123 and the encoder sensor 124 constitute a linear encoder (main scanning encoder) to detect the movement of the carriage 3.

A code wheel 125 is mounted on a shaft of the conveyance roller 13. An encoder sensor 126 being a transmissive photosensor is disposed to detect a pattern of the code wheel 125. The code wheel 125 and the encoder sensor 126 constitute a rotary encoder (sub-scanning encoder) to detect the movement amount and position of the conveyance belt 12.

In the liquid discharge apparatus 1000 thus configured, the sheet material P is fed and attracted onto the conveyance belt 12. With the sheet material P attracted on the conveyance belt 12, the conveyance belt 12 is circulated to convey the sheet material P in the sub-scanning direction SSD.

By driving the liquid discharge heads 41 in accordance with image signals while moving the carriage 3, liquid is discharged onto the sheet material P, which is stopped below the liquid discharge heads 41, to form one line of a desired image. Then, the sheet material P is fed by a predetermined distance to prepare for the next operation to record another line of the image.

On receipt of a recording end signal or a signal indicating that a trailing end of the sheet material P has arrived at a recording area, the liquid discharge apparatus 1000 terminates the print operation and ejects the sheet material P to a sheet ejection tray.

Figure 4:
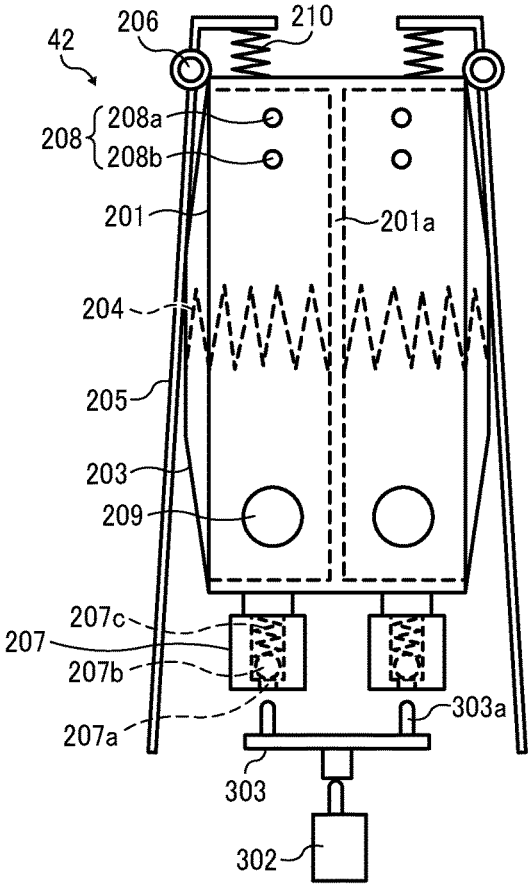
FIG. 4 is a plan view of a head tank of the liquid discharge apparatus of FIG. 1.
Figure 5:
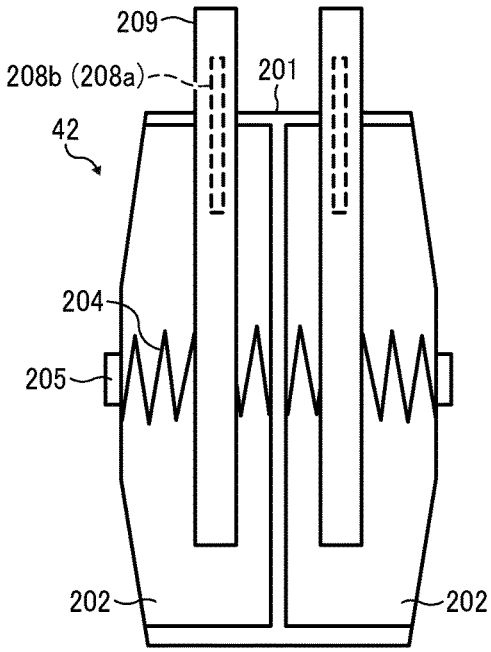
FIG. 5 is a front view of the head tank of FIG. 4.

Next, an example of the head tank is described with reference to FIGS. 4 and 5. FIG. 4 is a schematic upper plan view of the head tank. FIG. 5 is a schematic front view of the head tank of FIG. 4.

Each of the head tanks 42 has a tank case 201 including two liquid containing parts 202 to contain liquid and having openings at both lateral sides of the tank case 201. The liquid containing parts 202 are separated by a partition 201*a*.

The openings of the tank case 201 are sealed with films 203 being flexible members to form the liquid containing parts 202. Each film 203 is constantly pushed outward by a restoring force of a spring 204 as an elastic member disposed in the tank case 201.

As described above, since the restoring force of the spring 204 acts on the film 203 of the tank case 201, a decrease in the remaining amount of liquid in each liquid containing part 202 of the tank case 201 creates a negative pressure.

At the exterior of the tank case 201 is disposed a displacement member 205 that has one end swingably supported by a shaft 206.

The displacement member 205 is pressed against the film 203 of the tank case 201 by a spring 210. Accordingly, the displacement member 205 displaces with movement of the film 203, in other words, a change in the remaining amount of liquid.

The displacement member 205 is detected with, e.g., an apparatus-body-side sensor 301 as a body-side detector disposed at the apparatus body, thus allowing detection of the remaining amount of liquid or negative pressure in the head tank 42.

Supply port portions 209 are disposed at upper portions of the tank case 201 and connected to the supply tubes 56 to supply liquid from the main tanks 50.

At one lateral side of the tank case 201, an air release unit 207 openable and closable relative to the atmosphere is disposed to release the interior of the head tank 42 to the atmosphere.

The air release unit 207 includes, for example, an air release passage 207*a* communicating with the interior of the head tank 42, a valve body 207*b* to open and close the air release passage 207*a*, and a spring 207*c* to urge the valve body 207*b* into a closed state.

An air release solenoid 302 as an opening-and-closing unit of the apparatus body moves an opening-and-closing member 303 to push the valve body 207*b* by pin members 303*a*. Accordingly, the air release unit 207 is opened, thus causing the interior of the head tank 42 to be opened to the atmosphere (in other words, causing the interior of the head tank 42 to communicate with the atmosphere).

The head tank 42 includes electrode pins 208*a* and 208*b* (collectively referred to as electrode pins 208 unless distinguished) as a liquid level detector to detect a liquid level of liquid in the head tank 42.

Since liquid has electric conductivity, when the liquid level reaches the electrode pins 208*a* and 208*b*, electric current flows between the electrode pins 208*a* and 208*b* and the resistance values of the electrode pins 208*a* and 208*b* change. Such a configuration can detect that, for example, the liquid level has decreased to a threshold level or lower and the amount of air in the head tank 42 has increased to a threshold amount or greater.

Figure 6:
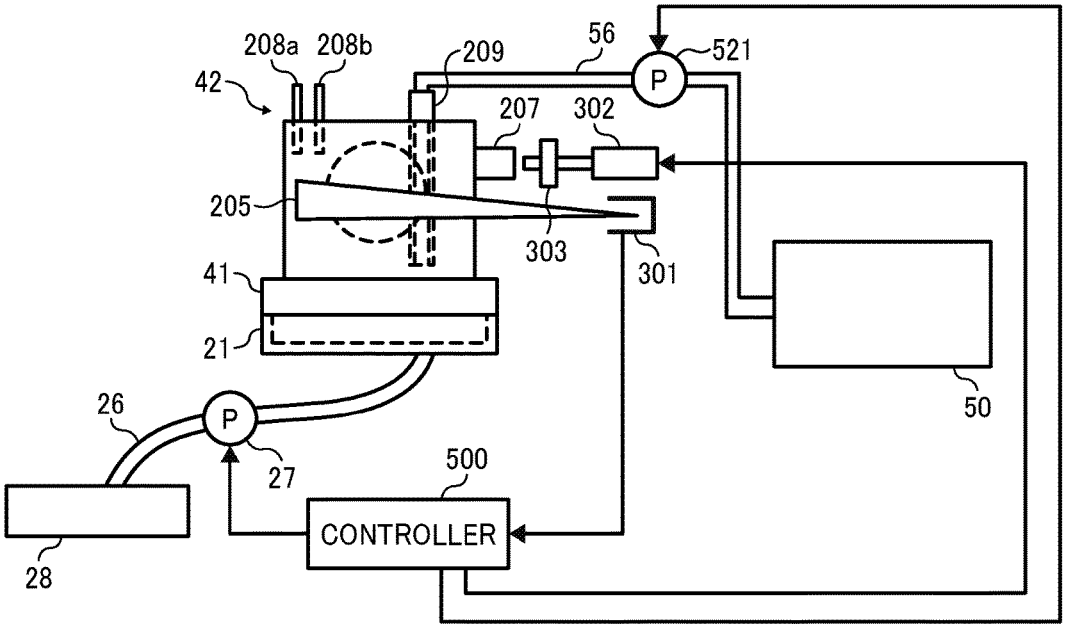
FIG. 6 is an illustration of a liquid supply-and-discharge system of the liquid discharge apparatus according to an embodiment of the present disclosure.

Next, a liquid supply-and-discharge system of the liquid discharge apparatus is described with reference to FIG. 6. FIG. 6 is an illustration of the liquid supply-and-discharge system according to an embodiment of the present disclosure.

A liquid feed pump 521 as a liquid feeder supplies liquid from the main tanks 50 to the head tanks 42 via the supply tubes 56.

The liquid feed pump 521 is a reversible pump (reversible liquid feeder) constituted of, e.g., a tube pump, capable of performing normal feed operation to supply liquid from the main tanks 50 to the head tanks 42 and reverse feed operation to return liquid from the head tanks 42 to the main tanks 50.

The maintenance device 20 includes the suction cap 21 to cap the nozzle face 41*a* of any one of the liquid discharge heads 41 and a suction pump 27 as a suction unit connected to the suction cap 21. The suction pump 27 is driven with the nozzle face 41*a* capped with the suction cap 21 to suck liquid from the nozzles 41*n* via a suction tube 26, thus allowing liquid to be sucked from the head tank 42. Waste liquid sucked from the head tank 42 is drained to a waste liquid tank 28.

The air release solenoid 302 as the opening-and-closing member to open and close the air release unit 207 of the head tank 42 is disposed at the apparatus body. By activating the air release solenoid 302, the air release unit 207 can be opened.

A controller 500 performs, e.g., driving control of the liquid feed pump 521, the air release solenoid 302, and the suction pump 27, detection of the displacement member 205 with the apparatus-body-side sensor 301, and control relating to negative-pressure generating operation.

Figure 7:
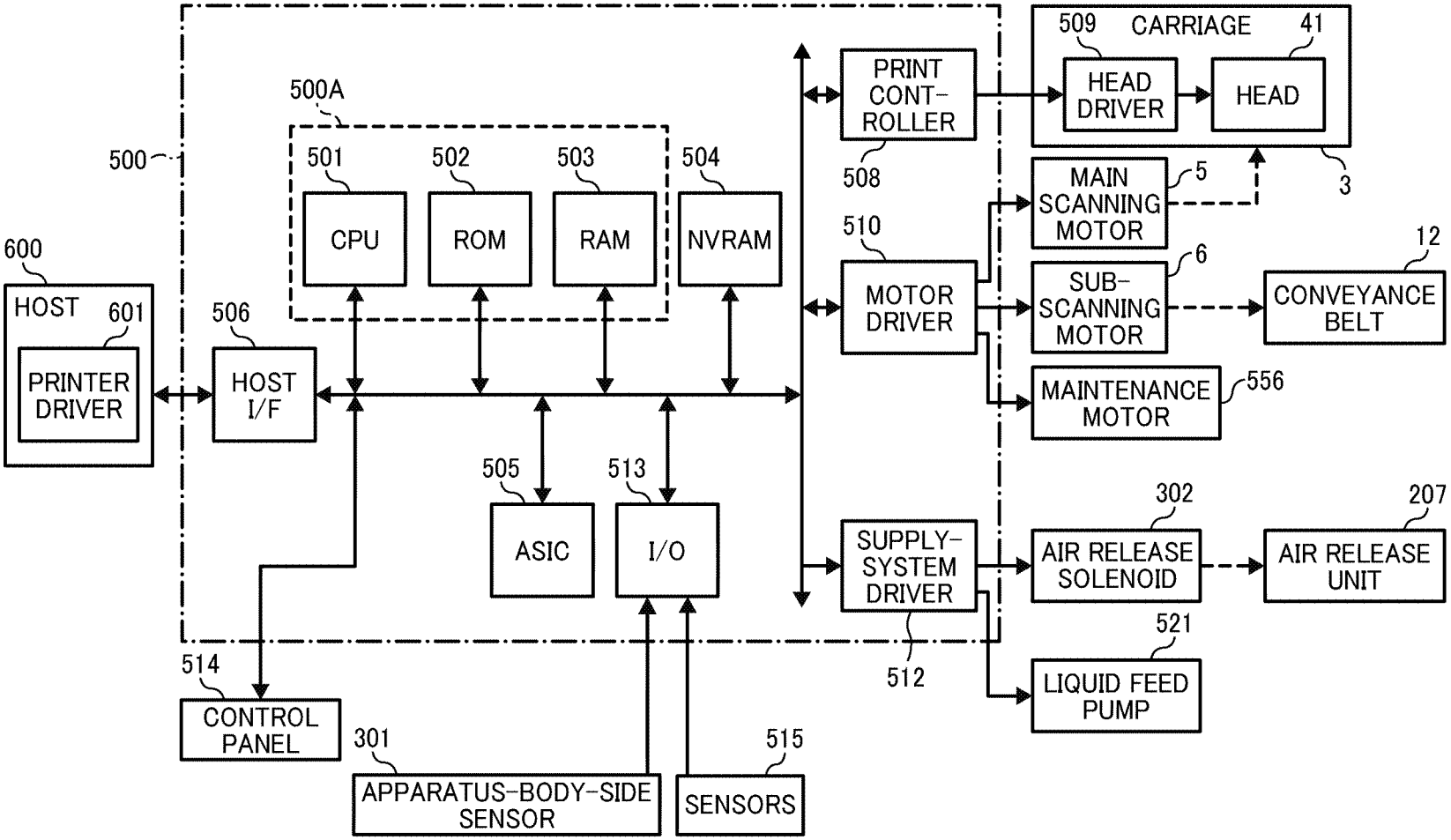
FIG. 7 is a block diagram of a controller of the liquid discharge apparatus according to an embodiment of the present disclosure.

Next, an outline of the controller of the liquid discharge apparatus is described with reference to FIG. 7. FIG. 7 is a block diagram of the controller of the liquid discharge apparatus according to an embodiment of the present disclosure.

As illustrated in FIG. 7, the controller 500 according to an embodiment of the present disclosure includes a main controller 500A that includes a central processing unit (CPU) 501, a read-only memory (ROM) 502, and a random access memory (RAM) 503. The CPU 501 administrates the control of the entire liquid discharge apparatus 1000. The ROM 502 stores fixed data, such as various programs including programs executed by the CPU 501, and the RAM 503 temporarily stores image data and other data.

The controller 500 further includes a non-volatile random access memory (NVRAM) 504 and an application specific integrated circuit (ASIC) 505. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print controller 508 and a head driver (driver integrated circuit) 509. The print controller 508 includes a data transmitter and a driving signal generator to drive and control the liquid discharge heads 41. The head driver 509 drives the liquid discharge heads 41 mounted on the carriage 3.

The controller 500 further includes a motor driver 510 to drive the main scanning motor 5, the sub-scanning motor 16, and a maintenance motor 556. The main scanning motor 5 moves the carriage 3 for scanning, and the sub-scanning motor 16 circulates the conveyance belt 12. The maintenance motor 556 moves the suction cap 21, the moisture-retention cap 22, and the wiper 23 of the maintenance device 20 and drives the suction pump 27.

The controller 500 further includes the air release solenoid 302 to open the air release unit 207 and a supply system driver 512 to drive the liquid feed pump 521.

The controller 500 is connected to a control panel 514 to input and display information necessary to the liquid discharge apparatus 1000.

The controller 500 further includes a host interface (I/F) 506 to transmit and receive data and signals to and from, e.g., a printer driver 601 of a host 600. The controller 500 receives data and signals by the host I/F 506 from the host 600, such as an information processing apparatus (e.g., a personal computer), an image reading device, or an image pick-up device, via a cable or network.

The CPU 501 of the controller 500 reads and analyzes print data stored in a reception buffer of the I/F 506, performs desired image processing, data sorting, or other processing with the ASIC 505, and transfers image data from the print controller 508 to the head driver 509.

The print controller 508 transfers the above-described image data as serial data and outputs to the head driver 509, for example, transfer clock signals, latch signals, and control signals required for the transfer of image data and determination of the transfer.

In addition, the print controller 508 includes the driving signal generator including, e.g., a digital/analog (D/A) converter (to perform digital/analog conversion on pattern data of driving pulses stored on the ROM 502), a voltage amplifier, and a current amplifier. The print controller 508 outputs a driving signal containing one or more driving pulses from the driving signal generator to the head driver 509.

In accordance with serially-inputted image data corresponding to one line recorded by the liquid discharge heads 41, the head driver 509 selects driving pulses of a driving waveform transmitted from the print controller 508 and applies the selected driving pulses to the pressure generator to drive the liquid discharge heads 41. Thus, the liquid discharge heads 41 are driven. At this time, by selecting a part or all of the driving pulses forming the driving waveform or a part or all of waveform elements forming a driving pulse, the liquid discharge heads 41 can selectively discharge dots of different sizes, e.g., large droplets, medium droplets, and small droplets.

An I/O unit 513 obtains information from the apparatus-body-side sensor 301 and various types of sensors 515 mounted on other devices in the liquid discharge apparatus 1000, extracts information necessary for controlling the liquid discharge apparatus 1000, and uses such information to perform various controls.

The main controller 500A is also a maintenance controller to control maintenance-and-recovery operation performed on the liquid discharge heads 41 with the maintenance device 20 and a calculation unit to calculate the amount of stain of the nozzle face 41*a* from a stain correlation value correlated with the degree of stain of the nozzle face 41*a*. The above-described controls are executed by the CPU 501 according to programs stored in the ROM 502.

Next, terms used in the present embodiment are described with reference to FIGS. 8 and 9. FIG. 8 is a table of environmental coefficients. FIG. 9 is a table of droplet-type coefficients.

The amount of stain of the nozzle face is a value calculated from a stain correlation value correlated with the degree of stain of the nozzle face. For example, the amount of stain of the nozzle face is calculated by $S+\Delta S$, where S represents the amount of stain and $\Delta S$ represents the increment of the amount of stain. The increment of the amount of stain, $\Delta S$, is calculated by multiplying a total of the numbers of droplets for discharged droplet types (droplet sizes) by different types of coefficients. The different types of coefficients include droplet-type coefficient and environmental-condition coefficient. In other words, when the amount of stain of the nozzle face is calculated, weights are assigned to environmental conditions and droplet types (droplet sizes).

For example, as illustrated in FIG. 8, environmental coefficients are defined by the combinations of temperatures and humidities. A lower-humidity environment is more likely to cause adhesion of liquid to the nozzle face 41*a* than a higher-humidity environment. A lower-temperature or higher-temperature environment is more likely to cause adhesion of liquid to the nozzle face 41*a* than an ordinary-temperature environment.

In the present embodiment, three types of droplet sizes: large droplet, middle droplet, and small droplet can be discharged. As illustrated in FIG. 9, a largest droplet-type coefficient is assigned to the small droplet and a smallest droplet-type coefficient is assigned to the large droplet. The assignment is employed because smaller droplets are more likely to adhere to the nozzle face 41*a*.

The term "first cleaning operation" represents first maintenance operation. The term "second cleaning operation" represents second maintenance operation. The second cleaning operation (second maintenance operation) is a maintenance operation that includes at least one of an operation in which the number of times of wiping with the wiper 23 is greater than in the first cleaning operation, an operation in which the number of times of sucking the liquid discharge head 41 with the suction pump 27 with the nozzle face 41*a* capped with the suction cap 21 ("head suction") is greater than in the first cleaning operation, and an operation in which at least one of the suction amount and the suction speed of sucking the liquid discharge head 41 with the nozzle face 41*a* capped with the suction cap 21. Note that, in the present embodiment, the suction amount is different between the first cleaning operation and the second cleaning operation.

The term "first threshold" represents a threshold to be compared with the amount of stain of the nozzle face from the second maintenance operation. The term "second threshold" represents a threshold to be compared with the elapsed time from the second maintenance operation. The term "third threshold" represents another threshold to be compared with the elapsed time from the second maintenance operation. The third threshold is greater than the second threshold. For example, the second threshold is 20 days and the third threshold is 100 days.

The terms "first head suction" and "second head suction" represent operations in which the liquid discharge head 41 is sucked with the suction pump 27 with the nozzle face 41*a* capped with the suction cap 21. The suction amount per operation is greater in the second head suction than in the first head suction. For example, the suction amount of the first head suction (first suction amount) is 0.2 cc and the suction amount of the second head suction (second suction amount) is 0.6 cc.

Figure 10:
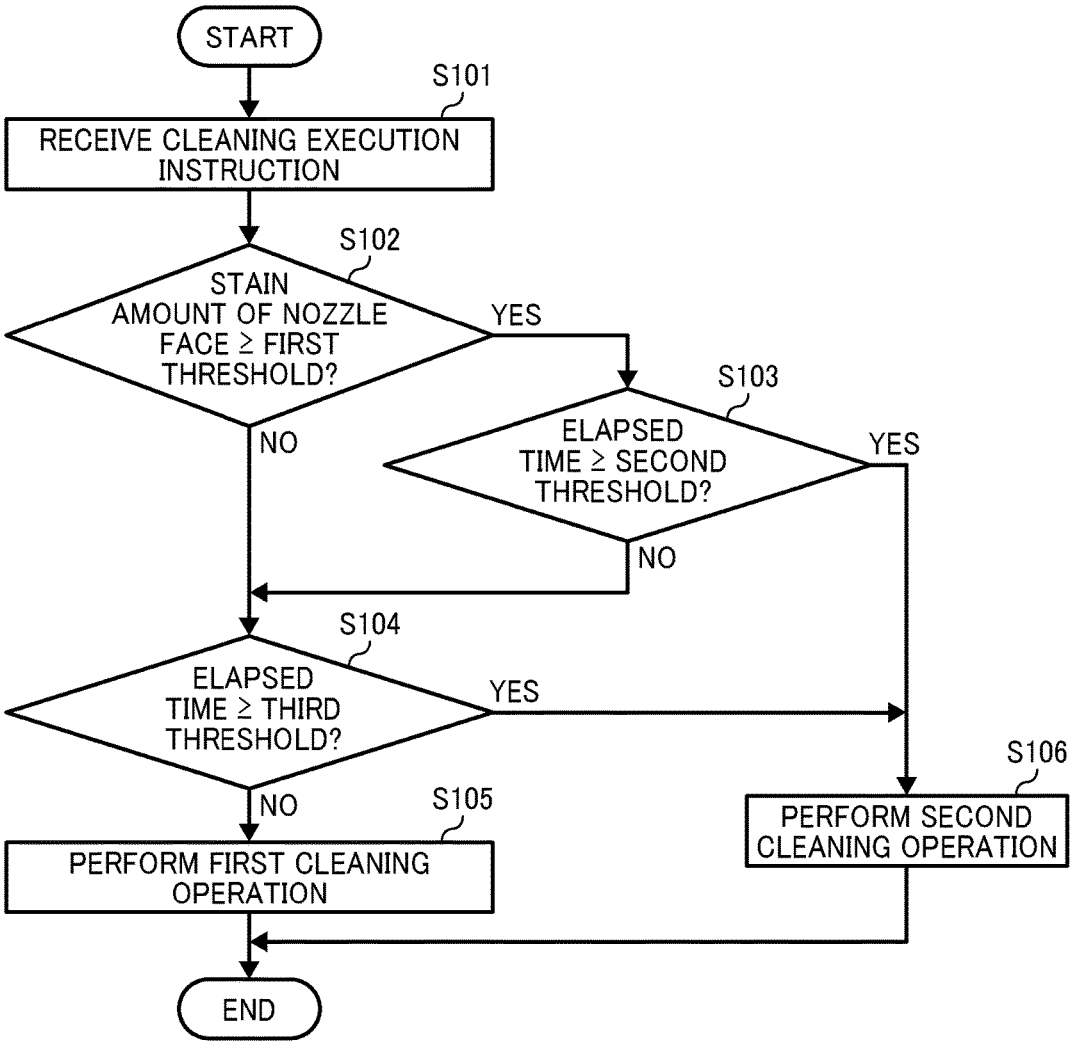
FIG. 10 is a flowchart of control of maintenance operation in a first embodiment of the present disclosure.

Next, control of the maintenance operation in a first embodiment of the present disclosure is described with reference to FIG. 10.

When the main controller 500A receives an execution instruction of the cleaning operation being the maintenance operation (S101), at S102 the main controller 500A determines whether the amount of stain of the nozzle face from a preceding round of the second cleaning operation is equal to or greater than the first threshold.

When the amount of stain of the nozzle face from the preceding round of the second cleaning operation is equal to or greater than the first threshold (YES at S102), at S103 the main controller 500A determines whether the elapsed time from the preceding round of the second cleaning operation is equal to or greater than the second threshold.

With a real time clock (RTC), the elapsed time can be calculated from a time at which the preceding round of the second cleaning operation has been performed and a time at which the main controller 500A receives the execution instruction of the cleaning operation. Alternatively, the elapsed time can be calculated from a count value of an internal counter from when the preceding round of the second cleaning operation has been performed to when the main controller 500A receives the execution instruction of the cleaning operation.

When the elapsed time from the preceding round of the second cleaning operation is equal to or greater than the second threshold (YES at S103), at S106 the main controller 500A controls the maintenance device 20 to perform the second cleaning operation.

When the elapsed time from the preceding round of the second cleaning operation is smaller than the second threshold (NO at S103), at S105 the main controller 500A controls the maintenance device 20 to perform the first cleaning operation. In the flowchart of FIG. 10, in connection to programs, when the elapsed time from the preceding round of the second cleaning operation is smaller than the second threshold (NO at S103), at S104 the process shifts to determination of whether the elapsed time is equal to or greater than the third threshold. However, as described above, the relationship of the second threshold being smaller than the third threshold is set. Accordingly, whenever the elapsed time is smaller than the second threshold, the elapsed time is smaller than the third threshold and the first cleaning operation is performed.

In other words, receiving the execution instruction of the maintenance operation, the main controller 500A controls the maintenance device 20 to perform the second maintenance operation when the amount of stain of the nozzle face from the preceding round of the second maintenance operation is equal to or greater than the first threshold and the elapsed time from the preceding round of the second maintenance operation is equal to or greater than the second threshold. The main controller 500A controls the maintenance device 20 to perform the first maintenance operation when the amount of stain of the nozzle face from the preceding round of the second maintenance operation is equal to or greater than the first threshold and the elapsed time from the preceding round of the second maintenance operation is smaller than the second threshold.

Receiving the execution instruction of the cleaning operation, when the amount of stain of the nozzle face from the preceding round of the second cleaning operation is smaller than the first threshold (NO at S102), at S104 the main controller 500A determines whether the elapsed time from the preceding round of the second cleaning operation is equal to or greater than the third threshold.

When the elapsed time from the preceding round of the second cleaning operation is equal to or greater than the third threshold (YES at S104), at S106 the main controller 500A controls the maintenance device 20 to perform the second cleaning operation.

When the elapsed time from the preceding round of the second cleaning operation is smaller than the third threshold (NO at S104), at S105 the main controller 500A controls the maintenance device 20 to perform the first cleaning operation.

In other words, receiving the execution instruction of the maintenance operation, the main controller 500A controls the maintenance device 20 to perform the second maintenance operation when the amount of stain of the nozzle face from the preceding round of the second maintenance operation is smaller than the first threshold and the elapsed time from the preceding round of the second maintenance operation is equal to or greater than the third threshold. The main controller 500A controls the maintenance device 20 to perform the first maintenance operation when the amount of stain of the nozzle face from the preceding round of the second maintenance operation is smaller than the first threshold and the elapsed time from the preceding round of the second maintenance operation is smaller than the third threshold.

As described above, the second maintenance operation is performed based on the amount of stain of the nozzle face and the elapsed time from the preceding round of the second maintenance operation. Such a configuration can reliably remove waste liquid by performing the maintenance operation before the degree of adhesion of waste liquid adhering to the nozzle face rises.

Figure 11:
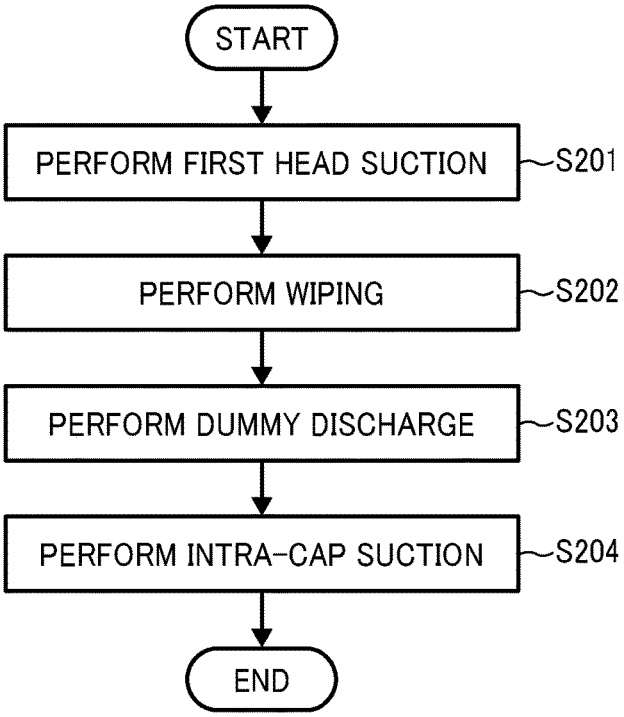
FIG. 11 is a flowchart of an example of a first cleaning operation in the first embodiment.

Next, an example of the first cleaning operation in the first embodiment is described with reference to FIG. 11.

In the first cleaning operation, at S201 the suction pump 27 is driven with the nozzle face 41*a* of the liquid discharge head 41 capped with the suction cap 21, to perform the first head suction to suck liquid from the nozzles 41*n* by the first suction amount. At S202, wiping is performed to wipe the nozzle face 41*a* of the liquid discharge head 41 with the wiper 23.

At S203, dummy discharge is performed from the liquid discharge head 41 into the suction cap 21. At S204, the suction pump 27 is driven to perform intra-cap suction to drain waste liquid from the interior of the suction cap 21 and the process ends. Note that dummy discharge can also be performed toward the second dummy discharge receptacle 24, which is the same as in the following operations.

Next, an example of the second cleaning operation in the first embodiment is described with reference to FIG. 12.

At S301, the air release unit 207 of the head tank 42 is opened to open the head tank 42 to the atmosphere. At S302, the liquid feed pump 521 is driven to feed from the main tank 50 to the head tank 42 until the head tank 42 is turned to an ink-full state. Note that the ink-full state represents a state in which liquid is detected with the electrode pins 208.

At S303, the suction pump 27 is driven with the nozzle face 41*a* of the liquid discharge head 41 capped with the suction cap 21, to perform the second head suction to suck liquid from the nozzles 41*n* by the second suction amount.

At S304, the main controller 500A determines whether the head suction has been successfully performed. In the determination, when the electrode pins 208 do not detect liquid, the main controller 500A determines that the head suction has been successfully performed. By contrast, when the electrode pins 208 still detect liquid, the controller 500 determines that the head suction has not been successfully performed.

Here, when the head suction has been successfully performed (YES at S304), at S305 the liquid feed pump 521 is driven from the main tank 50 to the head tank 42 to feed liquid until the head tank 42 is turned to the ink-full state. At S306, the air release unit 207 of the head tank 42 is closed.

At S307, the suction pump 27 is driven with the nozzle face 41*a* of the liquid discharge head 41 capped with the suction cap 21, to perform the first head suction to suck liquid from the nozzles 41*n* by the first suction amount. At S308, wiping is performed to wipe the nozzle face 41*a* of the liquid discharge head 41 with the wiper 23.

At S309, dummy discharge is performed from the liquid discharge head 41 into the suction cap 21. At S310, the suction pump 27 is driven to perform intra-cap suction to drain waste liquid from the interior of the suction cap 21 and the process ends.

Figure 12:
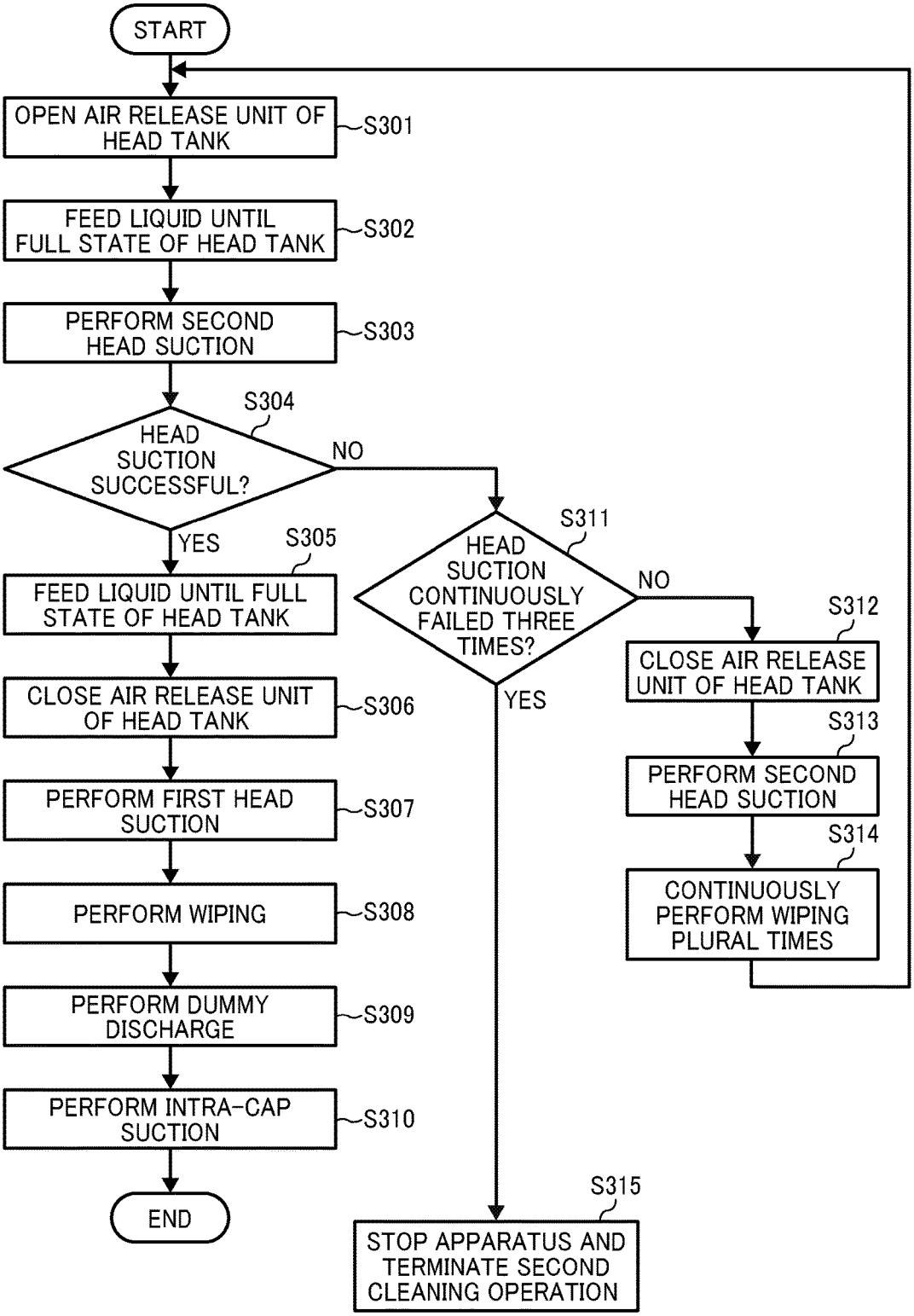
FIG. 12 is a flowchart of an example of a second cleaning operation in the first embodiment.

In other words, in the second cleaning operation of FIG. 12, the number of head suction operations is set to be greater than the first cleaning operation. The second cleaning operation of FIG. 12 also performs head suction operations including head suction (the second head suction) to suck liquid at a suction amount greater than the first cleaning operation.

In FIG. 12, when the head suction has not been successfully performed (NO at S304), at S311 the main controller 500A determines whether the head suction has continuously failed a predetermined number of times (e.g., three times) during one round of the second cleaning operation.

When the head suction has not continuously failed the predetermined number of times (e.g., three times) during one round of the second cleaning operation (NO at S311), at S312 the air release unit 207 of the head tank 42 is closed. At S313, the second head suction is performed to suck liquid by the second suction amount. At S314, the wiper 23 wipes the nozzle face 41*a* continuously a plurality of times. Then, the process returns to S301. After the air release (S301), the liquid feed (S302), and the head suction (S303) are performed, at S304 the main controller 500A determines whether the head suction has been successfully performed.

When the head suction has continuously failed the predetermined number of times (e.g., three times) during one round of the second cleaning operation (NO at S311), at S315 the main controller 500A determines a failure of the liquid discharge apparatus and terminates the process.

Figure 13:
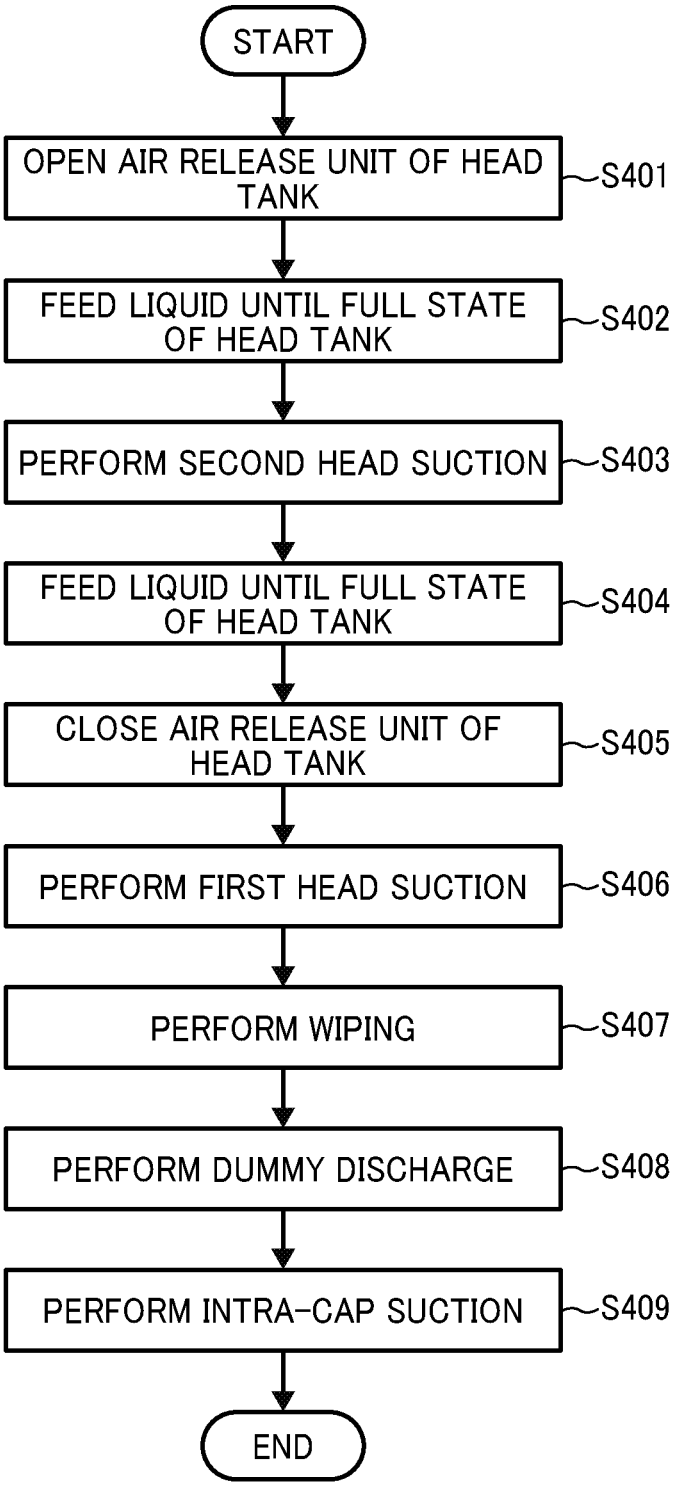
FIG. 13 is a flow chart of an example of the second cleaning operation in a second embodiment of this disclosure.

Next, an example of the second cleaning operation in a second embodiment of the present disclosure is described with reference to FIG. 13.

At S401, the air release unit 207 of the head tank 42 is opened to open the head tank 42 to the atmosphere. At S402, the liquid feed pump 521 is driven to feed from the main tank 50 to the head tank 42 until the head tank 42 is turned to an ink-full state.

At S403, the suction pump 27 is driven with the nozzle face 41*a* of the liquid discharge head 41 capped with the suction cap 21, to perform the second head suction to suck liquid from the nozzles 41*n* by the second suction amount.

At S404, the liquid feed pump 521 is driven to feed liquid from the main tank 50 to the head tank 42 until the head tank 42 turns to the ink-full state. At S405, the air release unit 207 of the head tank 42 is closed.

At S406, the suction pump 27 is driven with the nozzle face 41*a* of the liquid discharge head 41 capped with the suction cap 21, to perform the first head suction to suck liquid from the nozzles 41*n* by the first suction amount. At S407, wiping is performed to wipe the nozzle face 41*a* of the liquid discharge head 41 with the wiper 23.

At S408, dummy discharge is performed from the liquid discharge head 41 into the suction cap 21. At S409, the suction pump 27 is driven to perform intra-cap suction to drain waste liquid from the interior of the suction cap 21 and the process ends.

In other words, in the second cleaning operation in the second embodiment, the number of times of head suction operations is set to be greater than the first cleaning operation of the above-described first embodiment. In addition, the suction operation of the second head suction that is greater in suction amount is first performed.

However, when a plurality of rounds of suction operations is performed, at least one suction operation of the second head suction, which is greater in at least one of suction amount and suction speed than the first head suction being another round of suction operation, can be performed. The second head suction is not limited to the first suction operation, and may be a last suction operation or any suction operation between the first suction operation and the last suction operation.

Figure 14:
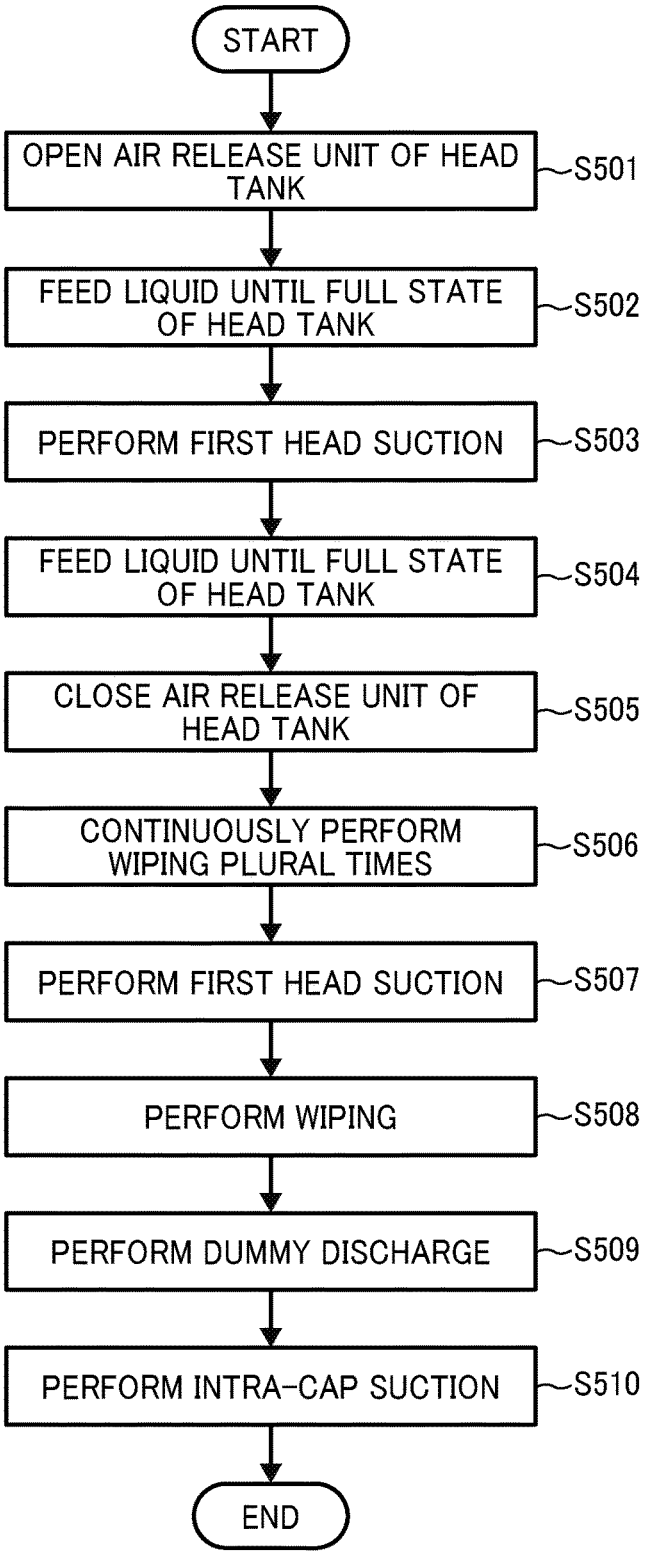
FIG. 14 is a flow chart of an example of the second cleaning operation in a third embodiment of this disclosure.

Next, an example of the second cleaning operation in a third embodiment of the present disclosure is described with reference to FIG. 14.

At S501, the air release unit 207 of the head tank 42 is opened to open the head tank 42 to the atmosphere. At S502, the liquid feed pump 521 is driven to feed from the main tank 50 to the head tank 42 until the head tank 42 is turned to an ink-full state.

At S503, the suction pump 27 is driven with the nozzle face 41*a* of the liquid discharge head 41 capped with the suction cap 21, to perform the first head suction to suck liquid from the nozzles 41*n* by the first suction amount.

At S504, the liquid feed pump 521 is driven to feed liquid from the main tank 50 to the head tank 42 until the head tank 42 turns to the ink-full state. At S505, the air release unit 207 of the head tank 42 is closed.

At S506, the wiper 23 performs wiping to wipe the nozzle face 41*a* continuously a plurality of times (for example, three times).

At S507, the suction pump 27 is driven with the nozzle face 41*a* of the liquid discharge head 41 capped with the suction cap 21, to perform the first head suction to suck liquid from the nozzles 41*n* by the first suction amount. At S508, wiping is performed to wipe the nozzle face 41*a* of the liquid discharge head 41 with the wiper 23.

At S509, dummy discharge is performed from the liquid discharge head 41 into the suction cap 21. At S510, the suction pump 27 is driven to perform intra-cap suction to drain waste liquid from the interior of the suction cap 21 and the process ends.

In other words, in the second cleaning operation of the third embodiment, the number of times of suction operations is set to be greater than the first cleaning operation of the above-described first embodiment. In addition, in the second cleaning operation of the third embodiment, the number of times of wiping in the wiping operation is also set to be greater than the first cleaning operation of the above-described first embodiment.

Next, a back-flow of mist when an electrostatic conveyance belt is used as the conveyance belt is described with reference to FIGS. 15A to 15D. FIGS. 15A to 15D are illustrations of an example of the back-flow of mist.

For a configuration in which an electrostatic conveyance belt to attract and retain a sheet material P by electrostatic attraction is used as the above-described conveyance belt 12, when droplets are discharged from the liquid discharge heads 41 onto the sheet material P attracted on the conveyance belt 12, a back-flow of mist toward the liquid discharge heads 41 is likely to occur and waste liquid is likely to adhere to the nozzle faces 41*a*.

Figure 15A:
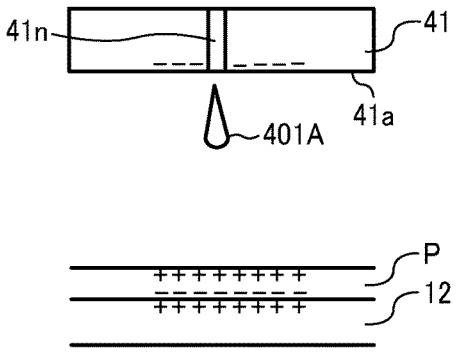
FIGS. 15A to 15D are illustrations of a back-flow of mist when an electrostatic conveyance belt is used as a conveyance belt.

In other words, as illustrated in FIG. 15A, a droplet 401A discharged from a nozzle 41*n* of the liquid discharge head 41 is affected by an electric field generated by a surface potential on the sheet material P attracted to the conveyance belt 12.

Figure 15B:
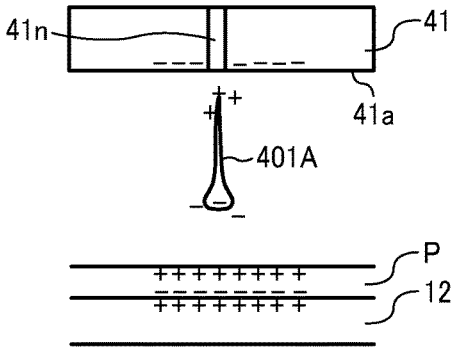
Figure 15C:
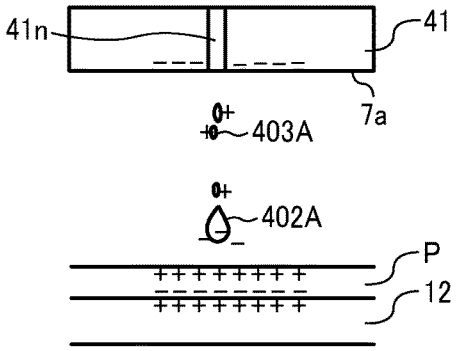
Figure 15D:
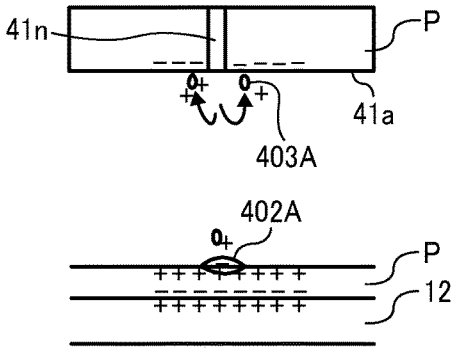

Accordingly, as illustrated in FIG. 15B, true charges are induced in the droplet 401A, and the droplet 401A is split into a main droplet 402A and mist (sub droplets) 403A. At this time, as illustrated in FIG. 15C, since the mist 403A is likely to be charged with the same polarity as the sheet material P, the mist 403A repels charges on the sheet material P having the same polarity. As a result, as illustrated in FIG. 15D, the mist 403A flows back to the nozzle face 41*a* of the liquid discharge head 41 and adheres to the nozzle face 41*a*.

As described above, in the configuration in which the electrostatic conveyance belt to attract the sheet material P by electrostatic attraction is used as the conveyance belt 12, waste liquid is likely to adhere to the nozzle face. However, according to the above-described embodiments of the present disclosure, such adhesion of waste liquid can be reliably removed.

In the above-described embodiments of the present disclosure, the liquid discharge apparatus includes the liquid discharge head or the liquid discharge device, and drives the liquid discharge head to discharge liquid. Examples of the liquid discharge apparatus include an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging liquid, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., liquid, treatment liquid, DNA sample, resist, pattern material, binder, mold liquid, or solution and dispersion liquid including amino acid, protein, or calcium.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit.

The main-scan moving unit may be a guide only. The supply unit may be a tube(s) only or a loading unit only.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head having a nozzle face in which a plurality of nozzles is arrayed to discharge liquid;

a cap to cap the nozzle face;

a wiper to wipe the nozzle face;

a maintenance device including a suction unit connected to the cap; and a maintenance controller to control the maintenance device to perform a maintenance operation on the liquid discharge head, the maintenance operation including a first maintenance operation and a second maintenance operation, the second maintenance operation including at least one of:

an operation in which a number of times of wiping of the wiper is greater than in the first maintenance operation;

an operation in which a number of times of suction of the nozzle face by the suction unit with the nozzle face capped with the cap is greater than in the first maintenance operation; and an operation in which at least one of a suction amount and a suction speed of the nozzle face by the suction unit with the nozzle face capped with the cap is greater than in the first maintenance operation, wherein the maintenance controller includes a calculator to calculate an amount of stain of the nozzle face from a stain correlation value correlated with a degree of stain of the nozzle face, wherein, receiving an execution instruction of the maintenance operation, the maintenance controller controls the maintenance device to perform the second maintenance operation when an amount of stain of the nozzle face from a preceding round of the second maintenance operation is equal to or greater than a first threshold and an elapsed time from the preceding round of the second maintenance operation is equal to or greater than a second threshold, and controls the maintenance device to perform the first maintenance operation when the amount of stain of the nozzle face from the preceding round of the second maintenance operation is equal to or greater than the first threshold and the elapsed time from the preceding round of the second maintenance operation is smaller than the second threshold.

2. The liquid discharge apparatus according to claim 1, wherein the maintenance controller controls the maintenance device to perform the second maintenance operation when the amount of stain of the nozzle face from the preceding round of the second maintenance operation is smaller than the first threshold and the elapsed time from the preceding round of the second maintenance operation is equal to or greater than a third threshold, the third threshold being greater than the second threshold, and wherein the maintenance controller controls the maintenance device to perform the first maintenance operation when the amount of stain of the nozzle face from the preceding round of the second maintenance operation is smaller than the first threshold and the elapsed time from the preceding round of the second maintenance operation is smaller than the third threshold.

3. The liquid discharge apparatus according to claim 1, wherein the calculator assigns a weight to an environmental condition to calculate the amount of stain of the nozzle face.

4. The liquid discharge apparatus according to claim 1, wherein the calculator assigns a weight to a droplet size to calculate the amount of stain of the nozzle face.

5. The liquid discharge apparatus according to claim 1, wherein the second maintenance operation includes a suction operation to suck the nozzle face by the suction unit with the nozzle face capped with the cap, wherein the maintenance controller determines whether the suction operation has been successfully performed, and wherein, when the maintenance controller determines that the suction operation has not been successfully performed, the maintenance controller controls the wiper to wipe the nozzle face and controls the suction unit to perform the suction operation again.

6. The liquid discharge apparatus according to claim 1, wherein the second maintenance operation includes a plurality of rounds of suction operations to suck the nozzle face by the suction unit with the nozzle face capped with the cap, and wherein the plurality of rounds of suction operations includes at least one round of a suction operation that is greater in at least one of suction amount and suction speed than another suction operation of the plurality of rounds of suction operations.

* * * * *